US009475996B2

(12) United States Patent
Mandle

(10) Patent No.: US 9,475,996 B2
(45) Date of Patent: Oct. 25, 2016

(54) CENTRIFUGAL FLUID RING PLASMA REACTOR

(71) Applicant: Richard Max Mandle, Palo Alto, CA (US)

(72) Inventor: Richard Max Mandle, Palo Alto, CA (US)

( * ) Notice: Subject to any disclaimer, the term of this patent is extended or adjusted under 35 U.S.C. 154(b) by 341 days.

(21) Appl. No.: 14/054,971

(22) Filed: Oct. 16, 2013

(65) Prior Publication Data

US 2014/0113980 A1 Apr. 24, 2014

Related U.S. Application Data

(60) Provisional application No. 61/715,050, filed on Oct. 17, 2012.

(51) Int. Cl.
*C10G 2/00* (2006.01)
*C10G 29/00* (2006.01)

(52) U.S. Cl.
CPC . *C10G 2/35* (2013.01); *C10G 2/32* (2013.01); *C10G 2/343* (2013.01); *C10G 29/00* (2013.01)

(58) Field of Classification Search
CPC ..... C10G 2/32; C10G 2/35; C10G 2/343; C10G 29/00; B01J 19/088; B01J 2219/0818
See application file for complete search history.

(56) References Cited

U.S. PATENT DOCUMENTS

| | | | |
|---|---|---|---|
| 1,091,529 | A | 3/1914 | Nash |
| 2,347,682 | A | 5/1944 | Gunness |
| 2,493,917 | A | 1/1950 | Hengstebeck |
| 3,996,012 | A | 12/1976 | Zucker |
| 4,455,232 | A | 6/1984 | Reid |
| 5,817,218 | A | 10/1998 | Hayashi et al. |
| 6,036,840 | A | 3/2000 | Christensen |
| 6,375,832 | B1 | 4/2002 | Eliasson et al. |
| 6,402,824 | B1 | 6/2002 | Freeman et al. |
| 7,033,551 | B2 | 4/2006 | Kong et al. |
| 7,642,292 | B2 | 1/2010 | Severinsky |
| 7,806,947 | B2 | 10/2010 | Gunnerman et al. |

(Continued)

FOREIGN PATENT DOCUMENTS

| | | |
|---|---|---|
| GB | 799039 | 7/1958 |
| WO | 98/11016 | 3/1998 |
| WO | 2004/016296 | 2/2004 |

OTHER PUBLICATIONS

PCT Written Opinion of the International Searching Authority, Jul. 13, 2012, for Int'l App'l No. PCT/US2012/33238, filed Apr. 12, 2012.

(Continued)

*Primary Examiner* — Kishor Mayekar
(74) *Attorney, Agent, or Firm* — Law Offices of Albert Wai-Kit Chan, PLLC

(57) ABSTRACT

The Centrifugal Fluid Ring Plasma Reactor employs a centrifugal impeller and a fluid barrier to mix multi-phase fluids and repeatedly move the mixture through a reaction zone, where the mixture contacts catalysts and/or is subjected to electromagnetic, mechanical, nuclear, and/or sonic energy to create ions, free radicals or activated molecules, which initiate or promote a desired reaction. In one embodiment, high-voltage electromagnetic energy is applied to Cobalt and Tungsten/Thorium electrodes in the reaction zone to create plasma. The Centrifugal Fluid Ring Plasma Reactor is suitable for converting carbon dioxide and methane into useful fuel products and for performing other multi-phase chemical reactions.

7 Claims, 1 Drawing Sheet

(56) References Cited

U.S. PATENT DOCUMENTS

| | | | |
|---|---|---|---|
| 2006/0140828 | A1 | 6/2006 | Winnington et al. |
| 2006/0247322 | A1 | 11/2006 | Li et al. |
| 2008/0105530 | A1 | 5/2008 | Bednarek et al. |
| 2008/0236160 | A1 | 10/2008 | Glotov |
| 2008/0256845 | A1 | 10/2008 | Meikrantz |
| 2009/0188157 | A1 | 7/2009 | Holloway, Jr. et al. |
| 2009/0293346 | A1 | 12/2009 | Birdwell, Jr. et al. |
| 2010/0008835 | A1 | 1/2010 | Birdwell, Jr. et al. |
| 2010/0329944 | A1 | 12/2010 | Hassan et al. |
| 2011/0190565 | A1 | 8/2011 | Novoselov et al. |
| 2014/0047761 | A1 | 2/2014 | Mandle et al. |

OTHER PUBLICATIONS

PCT International Preliminary Report on Patentability, Oct. 15, 2013, for Int'l App'l No. PCT/US2012/33238, filed Apr. 12, 2012.

Extended European Search Report, Dec. 5, 2014, for European App'l No. 12 771 074.7, filed Sep. 13, 2013.

DeBie, et al., 2011, "Dielectric barrier discharges used for the conversion of greenhouse gases: modeling the plasma chemistry by fluid simulations", Plasma Sources Science and Technology,20:024008 (11 pp).

Gallon, H. J. Thesis submitted to the University of Manchester for the Degree of Doctor of Philosophy in the Faculty of Engineering ad Physical Sciences, 2010, "Dry Reforming of Methane Using Non-Thermal Plasma-Catalysis".

Indarto, A., et al., 2005, "Kinetic Modeling of Plasma Methane Conversion Using Gliding Arc", Journal of Natural Gas Chemistry, 14:13-21.

Supat, et al., 2002, "Carbon Dioxide Reforming with Methane in low Temperature Plasmas", Fuel Chemistry Division Preprints, 47(1), 269-272.

U.S. Office Action, Oct. 2, 2015, for Richard Max Mandle, U.S. Appl. No. 14/110,736.

U.S. Office Action, Feb. 9, 2016, for Richard Max Mandle, U.S. Appl. No. 14/110,736.

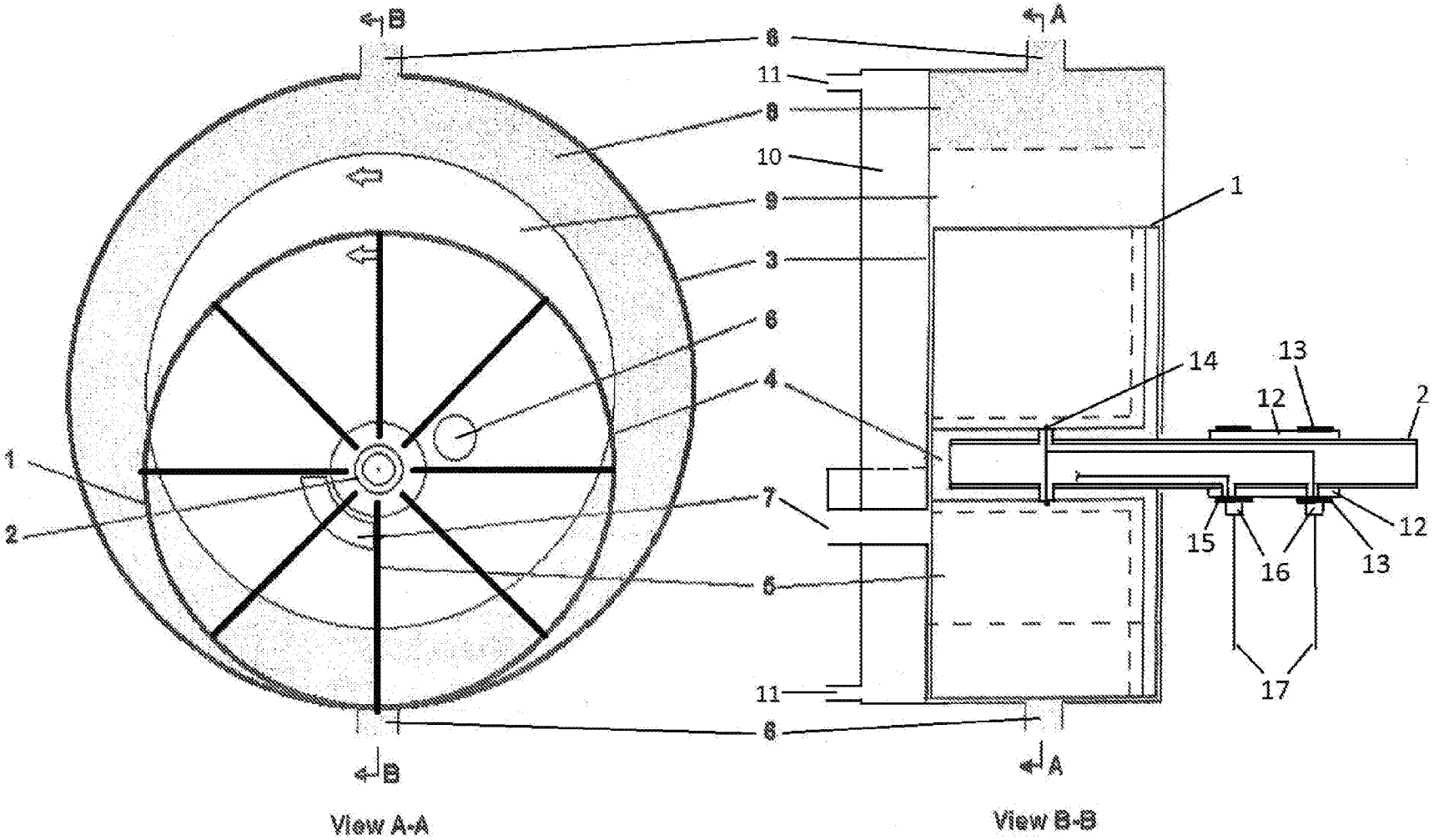
View B-B
View A-A
A
B
1
2
3
4
5
6
7
8
9
10
11
12
13
14
15
16
17

CENTRIFUGAL FLUID RING PLASMA REACTOR

Throughout this application, various publications are referred to and disclosures of these publications in their entireties are hereby incorporated by reference into this application to more fully describe the state of the art to which this invention pertains.

FIELD OF THE INVENTION

This invention is a centrifugal reactor, which provides means to mix reactive fluids and simultaneously contact them with catalysts and/or expose them to a variety of types of energy to promote a desired reaction. The fluids may be immiscible and have different densities and may include both liquids and gasses. In one embodiment, the reactor is suitable for converting carbon dioxide and methane into useful fuel products and for performing other multi-phase chemical reactions.

BACKGROUND OF THE INVENTION

There are strong economic and environmental incentives for converting carbon dioxide, methane and other low molecular weight sources of carbon into more useful chemicals and fuels. The Fischer-Tropsch process has been used for nearly a century to produce hydrocarbon fuel (gasoline, diesel, etc.) from gasified coal or natural gas at high temperatures and pressures assisted by catalysts. In that process, methane and steam can be reformed to Syngas (CO and $H_2$), which then can be further converted to fuel in the Fischer-Tropsch process. In another process, methane and carbon dioxide can also be reformed to form CO and $H_2$ for further processing into fuel. These processes require high temperatures and pressures and have high catalyst, energy and capital costs.

In the last few decades, methods have been developed for reforming low molecular weight carbon compounds, such as methane, propane, methanol and ethanol into higher molecular weight carbon compounds without using high temperature and pressure. These processes are described in numerous patents and scientific publications. Among the most promising processes being developed are those that employ non-thermal plasma to create free radicals, ions and/or activated molecules, which react to form larger, more useful molecules. These are discussed in the references in the "Reference" section later.

As described in detail in International Application PCT/US2012/033238 and U.S. Ser. No. 61/474,547, centrifugal force is commonly used to mix, move and/or separate fluids in reactors for chemical processes. Intense mixing of liquids and gases can be achieved in a centrifugal reactor, and energy to promote the desired reaction can be provided from outside the reactor or generated within it. The energy may be thermal, sonic, electric, radiant, mechanical or nuclear.

There are numerous ways to employ electrical energy to form ions and free radicals to initiate reactions. Electrical energy may be generated in the reactor by various means. An example is found in U.S. Pat. No. 7,806,947, "Liquid Hydrocarbon Fuel from Methane Assisted by Spontaneously Generated Voltage", Gunnerman, et al. ("Gunnerman"), wherein methane is bubbled up through a grid of catalytic metal wires immersed in a liquid petroleum fraction. The wires are insulated from a grounded frame. As the mixture of gas and liquid bubbles up through the catalyst grid, an electrical potential is generated between the catalyst wires and the frame. This electrical activity creates free radicals, which produce new molecules from the methane and liquid petroleum fraction and convert the methane to a liquid fuel. This method is in commercial use.

Instead of being generated within the apparatus as in "Gunnerman", the electrical energy may be provided from outside the reactor to form a high-voltage-induced plasma in the reactor. Low temperature plasmas induced by high voltage fields through a dielectric material are able to create ions, free radicals and activated molecules at ambient conditions with relatively low power requirements. In the reference titled "Carbon Dioxide Reforming with Methane in Low Temperature Plasmas", the authors discuss use of corona discharge and dielectric barrier discharge (DBD) plasmas to dissociate $CH_4$ and $CO_2$ and to reform the gasses to CO and $H_2$. A DBD cell or reactor is one in which two electrodes are separated by a dielectric, and the material to be treated passes through a space between the dielectric and one of the electrodes. The paper also compares plasma methods with the traditional thermal processes that require temperatures around 800° C. The plasma induced reaction proceeds as follows:

$$CH_4+CO_2 \rightarrow 2CO+2H_2 \text{ (Syngas)}$$

Numerous patents have been issued for devices and processes that use plasmas and arcs to initiate reactions to convert low molecular weight hydrocarbons and oxygenates into more useful higher molecular weight materials. A good overview of the state of the art is provided in US 2011/0190565, "Plasma Reactor for Gas to Liquid Fuel conversion", Novoselov et al. (the '565 patent), where the reactants are subjected to a pulsed high voltage discharge to convert low molecular weight hydrocarbons into a liquid fuel. The inventor calls the reactor a "non-thermal, repetitively-pulsed gliding discharge reactor". In the '565 patent, U.S. Pat. No. 7,033,551, "Apparatus and Method for Direct Conversion of Gaseous Hydrocarbons to Liquids", Kong et al. is cited as an example of using a DBD reactor, coupled to an electrochemical cell, to achieve a similar result. U.S. Pat. No. 6,375,832, "Fuel Synthesis", Eliasson et al. is cited in the '565 patent as an example of using a DBD reactor, packed with a solid catalyst, to convert methane and carbon dioxide into liquid fuel. The '565 patent also states that limiting factors of DBD systems are: "the non-chain character of the conversion processes . . . and the high activation energy (>400 KJ/mol.) of the primary radical formation process." Also, low current and power density reduce the capability of the DBD systems. The gliding arc [or non-thermal plasma] process activates the molecules to "vibrationally- and rotationally-excited levels, which requires less energy than forming radicals as in a DBD reactor, and is a chain reaction." The net result is a much lower energy requirement when a gliding arc, or direct non-thermal arc, is employed, as in the Centrifugal Fluid Ring Plasma Reactor.

The non-thermal arc process can be demonstrated in the laboratory with a simple device fashioned from a glass test tube or centrifuge tube (about 4.5×⅝ in.), two short pieces of tungsten/thorium welding rod, necessary tubing and stoppers and a source of variable high voltage, high frequency electric power. Water is put in the bottom of the tube to a depth of about ¾ in., and about two inches of light fuel such as kerosene is added above it. The two welding rods are inserted as opposing electrodes from the top so that their bottom ends are about 2 in. above the bottom of the glass tube. The electrodes are spaced about ⅛ in. apart at the bottom and about 9/16 in. apart at the top. The upper ends are attached to opposite poles of the power supply. A mixture of carbon dioxide and methane or propane is introduced below the water level through a glass tube. The top of the tube is sealed by suitable means. Gaseous products are removed from the top of the tube. After purging the system to remove all oxygen, electric power (5 to 10 Kv at 15 to 20 KHz) is applied to the electrodes. Voltage is increased until an arc is formed, and then reduced so that no "hot" arc is observed but power measurements indicate that plasma is formed. Carbon monoxide will be found in the gaseous effluent and waxy or oily material will form in the glass tube, which will show qualitatively that carbon dioxide is being reduced and high molecular weight material is being formed under these conditions.

None of the prior art discussed above has disclosed a centrifugal reactor for fluid reactants wherein a liquid ring is used to repeatedly move the mixed reactants back and forth through the rotor to contact them with catalysts and subject them to non-thermal plasma. However, centrifugal fluid ring reactors are disclosed in International Application Number PCT/US2012/033238, filed 4 Apr. 2012, which is incorporated in its entirety in this application by reference. This application claims improvements on the apparatus of PCT/US2012/033238.

SUMMARY OF THE INVENTION

This invention is a centrifugal reactor, which provides means to mix reactive fluids (reactants) and simultaneously contact them with catalysts and expose them to non-thermal plasma to promote a desired reaction. The fluid reactants may be immiscible and have different densities and may include both liquids and gasses. The reactor has a rotating element, or rotor (impellor), encased in a larger circular or elliptical casing. The rotor is situated in close proximity to a wall of the casing. The rotor draws in fluids through openings near the shaft, mixes them and ejects the mixture at its periphery. The rotor also imparts centrifugal force to a dense liquid to make it circulate around the inside walls of the casing as a fluid ring. The rotor is partially immersed in this fluid ring.

The dense liquid in the fluid ring may be inert or a product, reactant or mixture of products and reactants. As each part of the rotor turns into the fluid ring, the fluid ring stops the outward flow of reactants and forces them back into the rotor. Means are provided for those reactants to exit that part of the rotor as the fluid ring enters it. The fluid ring also transfers energy, separates products, scrubs the catalyst and otherwise assists the reaction.

Transition metal catalysts, such as cobalt, iron, nickel and tungsten, and radiation sources, such as Thorium and spent uranium, are part of the rotor so that reactants pass back and forth over them as the rotor revolves through the fluid ring. Sonic and mechanical shear energy is generated in the apparatus.

High-voltage electrical energy is provided from an external source to generate plasma in the reactor.

The centrifugal force can be used to quickly remove a gaseous or dense liquid product from the reaction zone to drive the reaction in a desired direction and increase yield of desired products.

BRIEF DESCRIPTION OF THE FIGURE

FIG. 1 is a schematic drawing of the Centrifugal Fluid Ring Plasma Reactor as described in Example 1 of the invention. The main functional features of a prototype are shown, but not necessarily as they actually are in the prototype. In one embodiment, the apparatus comprises a rotor (1) attached to a hollow shaft through its axis (2) and encased in a casing (3). The rotor is situated close to the wall of the casing.

The rotor is formed by a single ceramic disk (4) with a ceramic hub attached to a hollow drive shaft from an electric motor. An even number of blades (5) are attached to the disk and hub so that they extend radially from the hub to the periphery of the rotor. This forms chambers between the blades, which are the main reaction zones.

The rotor rotates and impels fluids out to the walls of the casing. Dense fluids form a fluid ring (8) around the inside of the casing, leaving less dense fluids and gasses in a central zone (9).

There are various openings, or ports, (6) in the casing to provide means for feeding fluids into the apparatus and removing fluids from the apparatus. A special port (7) is situated in the side of the casing to allow reactants to exit the rotor chambers as the fluid ring enters them. Fluids from port 7 are recycled externally (connection not shown) to a suitable inlet. The number, location and function of ports will depend on the process in which the reactor is used. In FIG. 1, fluids from the reaction zone are withdrawn from the reactor though port 7. Then the product is separated from the mixed fluids using suitable process equipment and conditions. The unreacted materials are returned to the reactor through a port (6) near the hub of the rotor, along with additional reactants.

One side of the casing is covered by a chamber (10), with ports (11) through which a heat transfer fluid is passed to add or remove heat from the reactor.

The blades of the rotor are sheets of catalytic metals. Alternate blades are connected electrically to opposing poles of a high voltage power supply so that they create electrical fields between them. Insulation is used wherever needed to keep the electricity from being diverted from that purpose. Between the casing and the motor, a portion of the shaft is covered by a sleeve of insulating material (12), which supports two slip rings of metal (13,15). An insulated wire (14) running through the hollow shaft connects slip ring 13 to each of the electrodes in one of two alternating sets of electrodes. In similar manner, the other slip ring (15) is connected to the other set of electrodes. Sliding contacts (16) that press against the slip rings are connected to opposite poles of a high voltage supply through wires (17) to supply opposite polarity voltage to the two sets of electrodes.

DETAILED DESCRIPTION OF THE INVENTION

The Apparatus

The apparatus is a centrifugal reactor, which provides means to mix reactive fluids (reactants) and simultaneously contact them with catalysts and/or expose them to a variety of types of energy to promote a desired reaction. The fluid reactants may be immiscible and have different densities and may include both liquids and gasses. The reactor has a rotating element, or rotor (impellor), encased in a larger circular or elliptical casing. The rotor draws in fluids by suitable means near the center, mixes the reactant fluids and ejects the mixture at its periphery.

The rotor also imparts centrifugal force to a dense liquid to make it circulate around the inside walls of the casing as a fluid ring. The rotor is situated in close proximity to one of the walls of the casing, where it is partially immersed in the fluid ring. It is possible to have the rotor close to two walls, e.g. at the ends of the minor axis of an ellipse, but that would seriously reduce the volume available for reactants, and any advantage in mixing intensity could be more practically be achieved by using another reactor in series or parallel with a reactor with the rotor in near proximity to only one wall.

The dense liquid in the fluid ring may be inert or a product, reactant or mixture of products and reactants. The fluid ring may also contain catalytic or chemically reactive materials in liquid or solid form, such as finely powdered ion exchange resins of the proper density. As each part of the rotor turns into the fluid ring, the fluid ring stops the outward flow of reactants and forces them back into the rotor. Means are provided for those reactants to exit that part of the rotor as the fluid ring enters it. Such means can be provided internally by rotor and casing design or externally by removing the reactants from the casing and recycling them to the central part of the casing. The fluid ring also transfers energy, separates products, scrubs the catalyst and otherwise assists the reaction.

The fluid ring may also act as a barrier between fluids, such as between low-density reactants and a dense product of the reaction, such as water. For this purpose, the barrier fluid must have a density intermediate between that of the fluids to be separated and must be immiscible with them. Silicone oils (e.g. dimethyl silanes), which are available with a range of properties, are one example of such a fluid. Finely powdered (e.g. 400 mesh), inert or reactive solids can also serve as a barrier ring fluid, such as polyethylenes, polyacrylates and ion-exchange resins.

Means are provided to add energy to the mixed reactants or to contact them with a catalyst in the rotor to promote the desired reaction. Catalyst may be part of the rotor, or may be contained in chambers on the rotor, so that fluid mixture passes back and forth over the catalyst as the rotor revolves through the fluid ring. Energy can be generated in the apparatus or supplied. Chemical, electrical, mechanical, nuclear, radiant and/or sonic energy may be employed. Electrical energy may be used to generate plasma in the reactor The rotor element is a generally cylindrical shape. It is mounted on a shaft that allows it to spin on its axis. The rotor is rotated by an external force acting on its shaft, as from an electric motor, or by a force acting directly on the rotor, such as magnetic drive.

The rotor has several functions: it acts as an impellor to impart centrifugal force to the reactant fluids, which in turn mixes the fluids and forms the dense fluid ring; it provides a reaction zone where various forms of energy initiate and promote the desired reaction; and it carries mixed fluids into the dense fluid ring so they are pushed back though the reaction zone. The rotor may consist of one or more disks, which act as the impellors of a centrifugal pump. The disks may also be in the form of fibrous brushes. The disks may have radial blades on them that increase impellor efficiency. The number of blades or chambers will depend on the size of the rotor and process variables, such as fluid viscosity, fluid density, etc., but normally will be at least eight.

Alternatively, the rotor may be comprised of blades that attach to and radiate from the axis and act like paddles to impart centrifugal force to the fluids. These blades may be solid, fibrous brushes, grids of catalyst wires on a suitable frame or combinations of these forms.

The volume enclosed by the rotor is generally where the desired reactions take place, or the reaction zone. Various means are employed there to promote the desired reaction by generating ions, free radicals and activated molecules in the mixed fluids. To accomplish this, the fibers, disks and/or blades may be partly or entirely fabricated of catalytic, piezoelectric or radioactive material, and/or may have chambers or other means to hold such materials.

The catalyst and/or other energetic form of activation for the reactions may differ from place to place in the reaction zone. For example, the fluid ring depth can be limited so that the inner part of the reaction zone would not be immersed in it. There, where gasses and entrained liquids predominate, activation means could be chosen to be effective with those reactants. In the outer part of the reaction zone where liquid mixtures predominate, different activation means could be employed.

In this device, electric energy is used to generate low temperature plasma in the reaction zone. Concurrently, heat and radiation can be applied through the casing walls or sides, or a stream of fluids can be with drawn for heating or radiation in separate equipment. Cooling can be accomplished in a similar manner.

The casing has walls and sides that enclose the rotor and provide room for the circulating fluid ring and the fluids outside the rotor. The sides of the casing are joined around their edges by walls that enclose a space with a volume substantially larger than that of the rotor. The casing sides are generally flat and parallel to the sides of the rotor, but the walls and sides around the reaction zone must be close to the rotor to restrict circulation of fluids between them and the rotor, so they must be configured to conform to a rounded rotor if one is used.

The space enclosed by the casing is preferentially circular or elliptical, but may be altered from these shapes to improve performance of the reactor, as for example: to form an arc long enough to completely close one of the chambers on the rotor; to form a bulge ahead of the rotor to accommodate water removal; etc. Likewise, the volume of the casing and the diameter of the rotor can be selected to meet process requirements, such as: viscosities of materials; vapor/liquid ratio; etc. Appropriately located ports provide means of feeding, removing and recycling fluids, e.g., feed and recycle liquids are preferentially injected near the shaft and feed and recycle gasses are preferentially injected through the liquid ring.

As each part of the rotor turns into the fluid ring, the fluid ring stops the outward flow of reactants and forces them back into the rotor. Means must be provided for those reactants to exit that part of the rotor and return to the central part of the reactor. There are many ways to accomplish this: for example, the blades can have an opening at the shaft to form a common channel around the shaft to all parts of the rotor, or a groove in the casing side around the shaft can achieve the same purpose. Fluids can also be withdrawn from the casing through a port and recycled externally to the central part of the reactor, as in FIG. 1.

Although it is particularly suited for use with solid catalysts, the apparatus can also be used as a high-intensity mixer for reactive fluids when a soluble or liquid catalyst is used, or when no catalyst is required.

EXAMPLE 1

In this example, the apparatus is configured as in FIG. 1 to employ non-thermal plasma in the rotor reaction zone.

The rotor is based on a single ceramic disk with a ceramic hub, which is attached to a hollow drive shaft from an electric motor. An even number of blades are attached to the disk and hub so that they extend radially from the hub to the periphery of the rotor. The blades extend axially from the disk to within a few thousands of an inch of the ceramic surface of the casing. This forms chambers, which are bounded by the disk, the blades and the inside of the casing. These chambers are the main reaction zones.

In this example, mixed reactants are pushed out of the chambers by the fluid ring through a port (7 in FIG. 1) near the hub.

The blades are electrodes for generating non-thermal plasma in the reaction zones between the rotor blades. Alternate blades are electrically connected to opposing poles of a source of high-voltage alternating current or intermittent direct current. One set of these alternating blade/electrodes is Cobalt and the other set is Tungsten containing 2% Thorium. The electrodes are electrically isolated from other parts of the apparatus. The opposing polarities of the electrodes create a high-voltage electric field in the radial gap between them, which creates non-thermal plasma in the reaction zone of the rotor.

The power source is a Realistic AC Power Supply, Model 106 Variac, which is connected to a Beckett 51838U Electronic Igniter. The electric field generates non-thermal plasma in the space between the blades. The voltage is adjusted to be less than that required to create a hot arc between the sets of electrodes, and is typically about 10,000 volts.

Description of the Process

The process employs the Apparatus to intimately mix fluids and to contact the mixture with catalyst and/or expose it to a variety of types of energy to promote a desired reaction in a reaction zone in the rotor. It is especially useful for intimately mixing gasses with immiscible liquids, such as aqueous and hydrocarbon liquids. Fluids can be injected through a suitable opening in the casing near the inlet of the rotor, so as to be thrown by centrifugal force outward through the reaction zone of the rotor. Fluids, especially gaseous fluids, may also be injected through the casing wall to pass through the dense ring of fluid circulating there. Fluids are removed through ports in the walls or sides of the casing. Some may be recycled to the reactor, and the rest is passed to another reactor or removed for separation of the constituent materials.

As the rotor spins, it mixes the feed and recycle fluids and throws the mixture outward through the reaction zone and out of the rotor. However, where the rotor is immersed in the fluid ring and close to the casing wall, the mixture cannot be thrown out of the rotor. At that point, ring fluid enters the chamber, forcing the reactant mixture to flow out of the chamber through a port provided in the casing near the shaft for this purpose or through an internal channel that returns mixed fluids to the other chambers.

The ring fluid is usually a dense layer of mixed feed and product fluids, or primarily the densest fluid in the process, but it can also be a fluid that does not participate directly in the reaction. Such a fluid must be chosen for its density, but other attributes are also to be considered, e.g., its ability to remove or react with intermediate products to help drive the reaction to completion or to scrub a catalyst to freshen its surface.

The ring fluid may serve as a barrier between process fluids. For example, a silicone oil or polymeric powder with density intermediate between water and hydrocarbon reactants, and immiscible with both, can be used as a fluid ring to isolate water from hydrocarbon reactants.

An example of a process where a barrier fluid ring may be useful is the Fischer-Tropsch reaction, where separating water from the lower density liquid and gaseous carbon compounds will drive the reaction toward completion.

Gaseous fluids may be fed through nozzles in the outer wall of the casing, or alternatively, through the side of the casing. The nozzles are designed to produce bubbles of the smallest possible size to enhance mixing and reaction with the other fluids. Ultrasonic nebulizers may be employed to achieve the desired small gas bubbles.

The casing is designed to accommodate the necessary fluid ring depth and to provide adequate room for a central gas zone that exposes the interior rim (i.e., furthest from the casing wall) of the rotor. The casing shape must permit circulation of the ring fluid and provide optimal mixing conditions where the rotor contacts the side of the casing. This dictates use of a generally round or elliptical casing. However, it may deviate from purely circular or ellipsoid to increase or decrease the arc where the rotor and the casing wall conform, provide riffles or pockets to collect dense product (e.g., water) or to enlarge or diminish the clearance upstream or downstream of the rotor contact point, as the viscosity, density or other fluid qualities may require.

The materials used to fabricate the reactor must be chosen to withstand the process fluids, which may be corrosive or abrasive. The fluids processed may include those with solids suspended in them.

The revolution speed of the rotor must be fast enough to sustain the circulating fluid ring, but slow enough to permit the desired reverse flow of fluids through the reaction zone, which can be observed through a transparent side of the casing or a window in the casing side. The proper revolution speed will vary with the viscosity and density of the fluids being processed.

The apparatus design can be adapted to meet a variety of process requirements, such as: ratio of reactants; viscosity of fluids, density of fluids; retention time in reactor, mixture characteristics, operating pressure, operating temperature, etc. For example, factors determining residence time include casing volume and the feed rate for reactants and recycle fluids, balanced by the withdrawal and recycle rates of the mixture of fluids.

Energy may be supplied to the reaction by several different means, either internally within the apparatus or externally through feed and recycle fluids. Likewise, energy from exothermic reactions may be removed in the apparatus, as with a cooling jacket, or externally by cooling the feed and recycle fluids.

Temperature in the fluids may be controlled by sensors to add or remove energy within the cavity or by external means. An electric potential can be applied to the reaction zone from an external source to generate plasma in the reactor. Necessary voltage depends on process requirements, such as: the dielectric strength of mixed fluids, the voltage and frequency of the power source, etc. Magnets in the casing can be employed to subject the contents of the chambers to a fluctuating magnetic field. The chamber may also contain an ionizing radiation source, or have radiation applied from an external source, such as infra-red, microwave, nuclear or ultraviolet.

The material withdrawn from the reactor, either as a mixture or as separate constituent parts, can be passed through additional reactors to increase yield of desirable products. Products are separated from unreacted original materials and purified by appropriate processes, such as extraction, distillation, settling, centrifugation, etc. The apparatus is used as one constituent of a system that requires pumps, settling tanks, centrifuges, heat exchangers, distillation columns, extraction columns, etc. as required for the process.

The centrifugal force in the reaction zone is believed to throw substances that interfere with catalyst efficiency, such as water on Cobalt catalysts, off of the catalyst surface, and so to improve catalyst performance. Use of flexible wire in the form of brushes or grids is believed to enhance this cleaning action. The fluid ring also scrubs the catalyst surface, particularly if the ring fluid is composed of powdered solids or contains entrained solids or bubbles.

Uses

The apparatus and process may be used for a wide variety of multi-phase reactions. It is well suited for recovering carbon from low molecular weight carbon compounds by reacting them with higher molecular weight carbon compounds, such as reacting natural gas with diesel fuel.

The Centrifugal Fluid Ring Plasma Reactor with a barrier fluid ring may be useful in the Fischer-Tropsch reaction, where separating water from the lower density liquid and gaseous carbon compounds will drive the reaction toward completion.

The Centrifugal Fluid Ring Plasma Reactor may also be useful in the production of biofuels, where small units located near ethanol plants could be used to convert the ethanol to motor fuel by reacting it with vegetable oils (triglycerides) to produce long chain fatty acid esters (biodiesel) and glycerin. In this process (see U.S. 2010/0008835 for a description of the process) immiscible ethanol and vegetable oil must be mixed with a catalyst and the denser glycerin must then be separated from the reactants.

What is claimed is:

1. An apparatus for mixing and promoting reaction between two or more reactants to form at least one reaction product, comprising:

a) a cylindrical casing comprising two sides and a cylinder wall, wherein said cylinder wall is either circular or elliptical;

b) a rotor within said cylindrical casing, said rotor comprising a circular disk with a hub at its center, a plurality of chambers that have one or more openings at a periphery of said circular disk, and an exit near said hub for exit of said two or more reactants or said reaction product; wherein said rotor further comprises:

i. one or more catalysts to promote reaction between said two or more reactants; and ii. one or more means to activate reactions between said two or more reactants by creating a non-thermal plasma, said one or more means comprising a plurality of radial elements connected to opposite poles of a high voltage power source, wherein said non-thermal plasma is formed between adjacent radial elements when a high voltage power is provided to said plurality of radial elements by said power source; and c) a shaft having one end connected to the hub of said rotor and another end passing through one of said two sides of the cylindrical casing to connect to a source of external force, such that said rotor is non-concentric to said cylindrical casing and, at any instance when the rotor rotates, comprises a closest position whereby one of said plurality of chambers is closer to said cylinder wall of the cylindrical casing as compared to the other chambers;

wherein, when one or more fluids are introduced into said cylindrical casing, rotation of said rotor imparts centrifugal force to said one or more fluids to cause said one or more fluids to circulate along the cylinder wall of said cylindrical casing to form a fluid ring; said fluid ring gradually entering each of said plurality of chambers of the rotor from said one or more openings when each of said plurality of chambers rotates to the closest position and is partially immersed in the fluid ring;

wherein, when said two or more reactants are introduced into said plurality of chambers for reaction, the two or more reactants or said reaction product are pushed out from the chamber approaching the closest position (closest-position chamber) through the exit near the hub when said fluid ring gradually enters said closest-position chamber as rotation of the rotor dips said closest-position chamber into the fluid ring; and wherein said two or more reactants or said reaction product reenter said closest-position chamber as rotation of the rotor draws said closest-position chamber away from said closest position and out of the fluid ring.

2. The apparatus of claim 1, wherein said plurality of radial elements comprise solid blades, fibrous brushes, wires strung across rigid frames, or combinations thereof.

3. The apparatus of claim 1, wherein said one or more fluids of the fluid ring comprise any one of:

a) two or more reactants;

b) said reaction product;

c) one or more materials immiscible with said two or more reactants or said reaction product;

d) one or more materials having a higher density than said two or more reactants;

e) one or more materials inert to said two or more reactants;

f) one or more materials inert to said reaction product; and g) one or more materials that catalyze the reaction between said two or more reactants.

4. The apparatus of claim 1, wherein said plurality of radial elements comprise two sets of radial elements, each set of radial elements being electrically insulated and connected to an opposite pole of said power source from the other set; wherein each radial element from one of said two sets of radial elements is arranged between two radial elements from the other set of radial elements.

5. The apparatus of claim 1, wherein said plurality of radial elements are made of one or more of cobalt, iron, nickel, tungsten, thorium, and uranium.

6. The apparatus of claim 1, wherein said high voltage power is a voltage of 10,000 volts or less, with a frequency in a range of 50 to 20,000 Hz.

7. The apparatus of claim 1, wherein said source of external force is an electric motor or magnetic drive.

* * * * *